United States Patent [19]

Holland et al.

[11] Patent Number: 4,531,673

[45] Date of Patent: Jul. 30, 1985

[54] SPRAY JET POLYMER POWDER WETTER

[75] Inventors: Hugh R. Holland, Cranford; Rosario Adamo, Belleville, both of N.J.

[73] Assignee: Pennwalt Corporation, Philadelphia, Pa.

[21] Appl. No.: 407,689

[22] Filed: Aug. 13, 1982

[51] Int. Cl.[3] ..... B05B 15/02; B05B 15/04

[52] U.S. Cl. ..... 239/113; 239/422; 239/425.5; 239/516

[58] Field of Search ..... 239/418, 421, 419.5, 239/424.5, 424, 425, 523, 422, 113, 425.5, 505, 516

[56] References Cited

U.S. PATENT DOCUMENTS

| | | | |
|---|---|---|---|
| 2,530,671 | 11/1950 | Wahlin | 239/523 |
| 2,746,728 | 5/1956 | Pomerleau | 239/421 |
| 3,174,693 | 3/1965 | Weber, Jr. | 239/422 |
| 3,214,103 | 10/1965 | Kempthorne | 239/422 |
| 3,521,824 | 7/1970 | Wilcox | 239/424.5 |
| 3,852,022 | 12/1974 | Medeot | 239/424 X |
| 4,200,232 | 4/1980 | Fraley et al. | 239/425.5 |

*Primary Examiner*—Andres Kashnikow
*Assistant Examiner*—Michael J. Forman

[57] ABSTRACT

Wetting device for wetting and dissolving polymer powders without forming lumps and globular "fish-eyes" which clog the system apparatus. A nozzle holder has an annular passageway disposed therein which communicates with each of a plurality of spaced jet spray nozzles secured to the holder on a bottom face thereof in the form of a ring. Alternate nozzles spray inwardly forming a turbulent curtain of water. Remaining nozzles spray outwardly against inner wall of a spray confining cylinder to wash down polymer therefrom. An open-ended, powder receiving, tubular flexible insert extends through a central opening of the nozzle holder creating an annular space around the flexible insert. Water supplied to the passageway sprays from the nozzles to induce a downward airstream in the annular space to aid in drawing powder through the insert while simultaneously maintaining the powder in a finely divided state when falling into the turbulent curtain of water.

5 Claims, 3 Drawing Figures

SPRAY JET POLYMER POWDER WETTER

STATEMENT OF THE INVENTION

This invention relates to apparatus for forming solutions from polymer powders and more particularly to improved apparatus for forming such solutions which are free of lumps and globular "fish-eyes".

BACKGROUND AND SUMMARY OF THE INVENTION

It is known that the addition of a low concentration solution of various polymers or polyelectrolytes to sewage or wastewater effluent, for example, will promote floc formation of unwanted particulate matter suspended therein. The solutions are also useful in the centrifugation of alum muds; in the gravity settling of steel mill scale, waste pickle liquor, rolling mill wastes, as well as zinc, chromate, latex, and sugar mill wastes and tannery wastewater; in brine clarification for recovering magnesium compounds from seawater; in the clarification of beet and sugar cane juice; in sludge conditioning; as filtration aids, and like.

When particulate polymers are exposed to air containing moisture, many become sticky and form lumps quite rapidly. When exposed to water, the polymers become gummy and are difficult to dissolve or handle. Further, unless the polymer is maintained in a finely divided state when it comes into contact with the water, lumps and globular fish-eyes form which clog the feed-pump, feedlines, and related apparatus of the system used in producing aged batches of polymer solution.

Additionally, polymeric powders are dusty and readily adhere to moist surfaces resulting in a build-up of semi-solid material thereon, to thereby render the wetting apparatus considerably less effective as well as requiring the apparatus to be subjected to frequent shut-down and clean-out.

The present invention provides a jet spray polymer powder wetter which permits the powder to fall into an open-ended tubular flexible insert member which is caused to extend centrally through the opening of an annularly shaped nozzle holder. The insert member has a smaller diameter than the opening and hence an annular space exists around the insert. A plurality of spaced jet spray nozzles are secured to a bottom face of the nozzle holder. The nozzles communicate with an annular passageway provided in the nozzle holder. Thus, water under pressure, supplied to the passageway, causes each nozzle to issue a high velocity jet spray therefrom. The sprays from the nozzles are directed inwardly and outwardly in alternating relationship. The inwardly directed sprays form a turbulent curtain of water which bombard the powder falling thereinto for complete wetting thereof. The outwardly directed sprays impinge against the inner wall of a spray confining cylindrical shield to constantly wash down its walls of any polymer which might be clinging thereto or attempting to build up thereon. The shield confines the sprays therewithin and leads down to a conventional aging tank.

The jet sprays induce a downward airstream in the space created in the central opening between the insert and nozzle holder which airstream aids in drawing the powder through the flexible insert as well as helping to maintain the falling powder in a finely divided state.

The apparatus of the present invention enables the wetting and mixing of the polymer powders to be accomplished in a dust-free environment and provides no moist solid surfaces to or upon which the powder can cling, thus effectively preventing any build-up of sticky material to clog vulnerable components of the system.

DETAILED DESCRIPTION OF THE DRAWINGS

Figure 2:
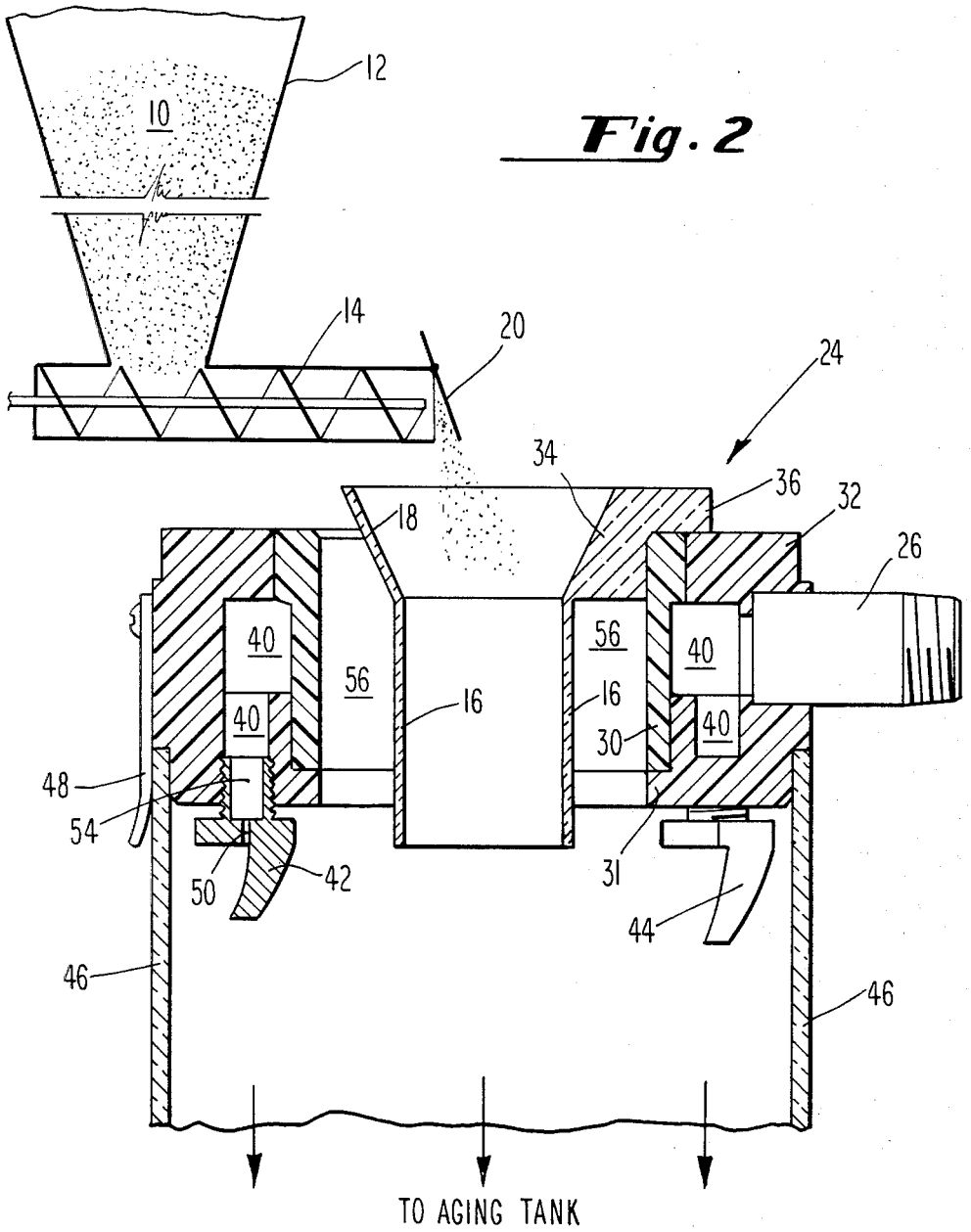
FIG. 2 is a sectional view of the apparatus of FIG. 1 taken along line 2—2 thereof, including a diagrammatic illustration of several components used with the apparatus.

Referring to the drawings, and more particularly to FIG. 2, a particulate powder of dry polymer material 10 within hopper 12 is fed by a rotating volumetric screw feeder 14 into an open-ended flexible insert tube 16, suitably of plastic and transparent. Flexible insert tube 16 includes an upper flared portion 18 to facilitate entry of powder 10 thereinto. A suitable powder shut-off gate 20 is caused to open and close by hydraulic cylinder means (not shown).

Flexible insert tube 16 is supported on a jet spray nozzle holder 24 which is supported by a water supply pipe (not shown) connected to water inlet nipple 26 through which water is supplied to annular passageway 40, later described, provided within nozzle holder 24. Nozzle holder 24 may conveniently be molded from PVC and typically measures about 6 inches in diameter; it will be annularly configured and comprises a hollow cylindrical chamber insert 30 cemented to a chamber 32, into which is secured nipple 26.

Flexible insert tube 16 is provided with a plurality of webs 34 (three shown in FIG. 1) which abut chamber insert 30 to thereby maintain flexible insert tube 16 centered therewithin. Webs 34 include an upper horizontally extending portion 36 which rests atop nozzle holder 24 for support of insert tube 16 thereon.

Chamber insert 30 and chamber 32 are configured to form an annularly shaped passageway 40 for the passage of water therearound. A plurality of jet spray nozzles 42 and 44 are threadedly mounted to the bottom face 31 of chamber 32 to form a ring about a lower portion of insert tube 16. A plastic and transparent cylindrical shield 46 is removably secured to chamber 32 by means of spring clips 48.

Figure 1:
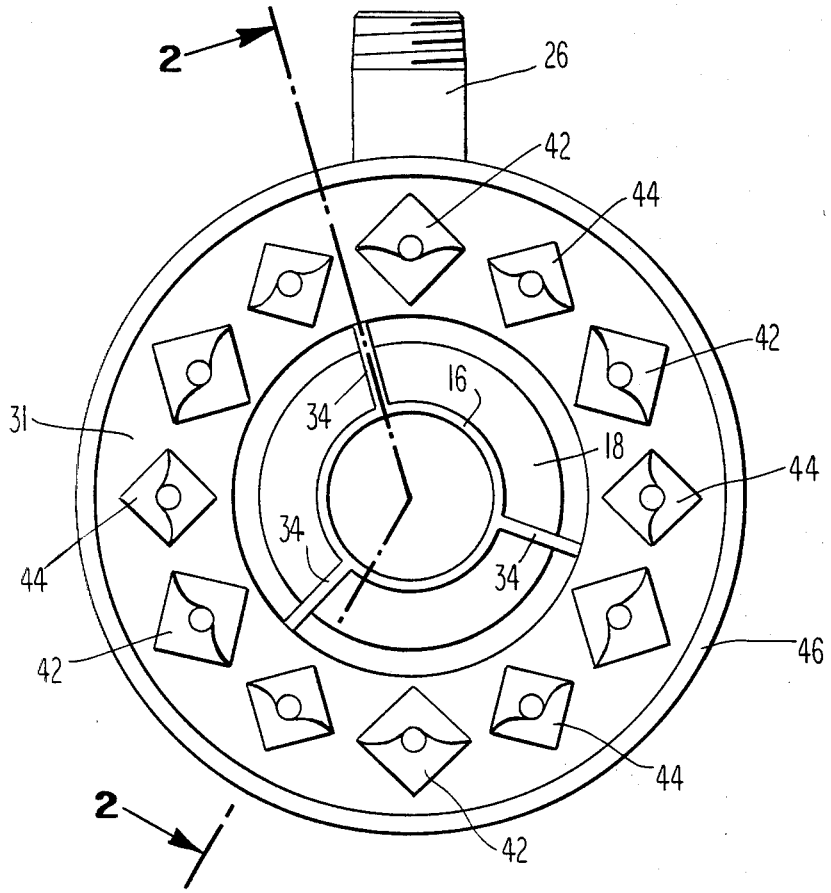
FIG. 1 is a bottom view of the apparatus of the present invention.
Figure 3:
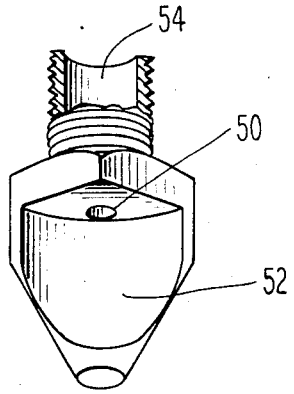
FIG. 3 is a perspective view of a typical jet spray nozzle shown in FIGS. 1 and 2.

Nozzles 44, facing inwardly, are disposed alternately with nozzles 42, facing outwardly. A total of 12 nozzles are employed in the drawing of FIG. 1. Each nozzle 42 and 44 is provided with an orifice 50, a curved spray plane 52, and a bore 54 communicating with passageway 40. Water under pressure passes through bore 54 to be ejected as a high velocity jet through orifice 50. The jet of water strikes curved deflector plane 52 and is thus deflected to create a pattern of hard hitting spray. The deflector planes 52 of inwardly facing nozzles 44 create a turbulent curtain of water into which the powdered polymer 10 falls. The deflector planes 52 of outwardly facing nozzles 44 create a spray pattern which constantly washes down the inner walls of shield 46 to prevent any build-up of polymer thereon. As illustrated in FIGS. 1 and 2, nozzles 44 are larger than nozzles 42. Similarly, orifices 50 of nozzles 44 are preferably proportionally larger in diameter than the orifices of nozzles 42.

In operation, the high velocity jet sprays from each of nozzles 42 and 44 cause a reduced pressure area to form thereabove which induces a greater portion of a downward airstream to flow in annular space 56, and a lesser portion of the downward airstream aids in drawing powder 10 through insert tube 16 as well as maintaining the powder in a finely divided state when it falls into the turbulent curtain of water formed by nozzles 44. The airstream flowing in space 56 is free from polymer dust and consequently the nozzles do not become coated.

The spray angle is fixed and the capacity of the nozzles is held constant by a water flow controller. Thus, the desired optimum spray patterns are maintained, during varying water pressures and by the fixed configuration of the deflector planes 52. Typically, nozzles may be fabricated from brass or stainless steel.

Some advantages derived from practice of the present invention are:

(1) lumping and fish-eyeing are minimized since the falling powder is substantially maintained in a finely divided state by the induced downward airstream; any powder not maintained in a finely divided state is bombarded by the turbulent curtain of water and simultaneously completely wetted thereby;

(2) semi-solid build-up of clinging and sticky polymer material is minimized by nozzles 42;

(3) the induced airstream in space 56 helps to maintain the nozzles and spray confining cylindrical shield 46 dust free; and (4) flexible insert 16 may be readily removed for cleaning.

We claim:

1. Polymer powder wetting device wherein said powder is wetted without the formation of lumps and globular fish-eyes comprising an annular nozzle holder having a central opening, said nozzle holder including an annular passageway therewithin, a plurality of spaced nozzles secured to said nozzle holder, each of said nozzles communicating with said passageway, an open-ended tubular insert supported by said nozzle holder and disposed centrally through said opening to form an annular space exteriorly to said insert and within said opening, means for introducing said powder into said insert, a cylindrical shield removably dependent from a lower peripheral portion of said nozzle holder, means for introducing water into said passageway, said nozzles creating spray patterns from said water to induce a downward airstream in said annular space, said annular space exposed only to ambient atmosphere at its upper end, said airstream aiding in drawing said powder through said insert and maintaining said powder in a finely divided state while falling into said spray patterns for complete wetting of said powders, and wherein one-half of said plurality of spaced nozzles have deflector planes facing radially inwardly and remainder of said nozzles have deflector planes facing radially outwardly, said nozzles with said inwardly and outwardly facing deflector planes being disposed in alternating relationship, said nozzles with inwardly facing deflector planes creating jets of high velocity water directed inwardly against said powder falling through said insert and said remaining nozzles creating jets of high velocity water directed outwardly against inner walls of said cylindrical shield.

2. Polymer powder wetting device comprising an annular nozzle holder having a central opening, said nozzle holder including an annular passageway therewithin, a plurality of spaced nozzles secured to said nozzle holder, each of said nozzles communicating with said passageway, an open-ended tubular insert supported by said nozzle holder and disposed centrally through said opening to form an annular space exteriorly to said insert and within said opening, said insert provided with a plurality of spaced webs extending therefrom, said webs maintaining said insert centrally within said opening by means of said webs abutting an interior portion of, and resting atop said nozzle holder, means for introducing said powder into said insert, means for introducing water into said passageway, said nozzles creating a spray pattern from said water to induce a downward airstream in said annular space, said annular space exposed only to ambient atmosphere at its upper end, a cylindrical shield depending from a peripheral portion of said nozzle holder for embracing said nozzles therewithin, each of said nozzles comprising an integral member including a connecting plug portion, a curved deflector plane, and a body portion thereinbetween, said plug portion having a bore communicating with said passageway, and said body portion having an orifice therethrough communicating with said bore and deflector plane to create a jet of high velocity water which is deflected by said deflector plane into said spray pattern, said connecting plug portion including threads for threadedly mounting said nozzles into a bottom portion of said nozzle holder, said nozzles being annularly disposed in said bottom portion of said nozzle holder, and wherein one-half of said nozzles have deflector planes facing radially inwardly and one-half of said nozzles have deflector planes facing radially outwardly, said nozzles with said inwardly and outwardly facing deflector planes being disposed in alternating relationship.

3. Wetting device of claim 2 wherein said nozzles with deflector planes facing inwardly produce said spray pattern in the form of a turbulent curtain of water.

4. Wetting device of claim 2 wherein said nozzles with deflector planes facing outwardly produce said spray pattern against inner walls of said shield.

5. Wetting device of claim 2 wherein lowermost portion of said insert and nozzle orifices are substantially in a horizontal plane.

* * * * *